US007901478B2

(12) United States Patent
Suttels

(10) Patent No.: US 7,901,478 B2
(45) Date of Patent: Mar. 8, 2011

(54) RESERVOIR FOR A REPLACEMENT FLUID FOR A DEVICE AND A DEVICE, TOGETHER WITH AN OIL SEPARATOR FITTED WITH SUCH A RESERVOIR

(75) Inventor: Alain Suttels, Leuven (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 173 days.

(21) Appl. No.: 12/224,789

(22) PCT Filed: Jan. 11, 2007

(86) PCT No.: PCT/BE2007/000006

§ 371 (c)(1),
(2), (4) Date: Sep. 5, 2008

(87) PCT Pub. No.: WO2007/101314

PCT Pub. Date: Sep. 13, 2007

(65) Prior Publication Data

US 2009/0028737 A1 Jan. 29, 2009

(30) Foreign Application Priority Data

Mar. 7, 2006 (BE) ..... 2006/0145

(51) Int. Cl.
*B01D 45/12* (2006.01)

(52) U.S. Cl. ..... 55/459.1; 55/466

(58) Field of Classification Search ..... 55/466, 55/423, 459.1, DIG. 17; 418/97
See application file for complete search history.

(56) References Cited

U.S. PATENT DOCUMENTS

| | | | | |
|---|---|---|---|---|
| 2,943,705 | A * | 7/1960 | Staunt | 184/55.2 |
| 3,447,636 | A | 6/1969 | Bonfilio | |
| 2005/0167351 | A1 | 8/2005 | Herman et al. | |

FOREIGN PATENT DOCUMENTS

| | | |
|---|---|---|
| EP | 1 061 251 A2 | 12/2000 |
| EP | 1 275 402 A1 | 1/2003 |
| JP | 01063710 | 3/1989 |
| JP | 2001-329961 | 11/2001 |
| JP | 2005-034383 | 2/2005 |

* cited by examiner

*Primary Examiner* — Robert A Hopkins
(74) *Attorney, Agent, or Firm* — Bacon & Thomas, PLLC

(57) ABSTRACT

Reservoir for a replacement fluid for a device, where the reservoir (3) is pre-filled with the desired quantity of the relevant replacement fluid (15) And where this reservoir is equipped with detachable coupling devices (29) which make it possible to mount and dismantle the reservoir (3) on the device (1) and where the reservoir (3), in its mounted state, serves as a changeable fluid.

9 Claims, 6 Drawing Sheets

RESERVOIR FOR A REPLACEMENT FLUID FOR A DEVICE AND A DEVICE, TOGETHER WITH AN OIL SEPARATOR FITTED WITH SUCH A RESERVOIR

This invention relates to a reservoir for a replacement fluid for a device.

The term 'replacement fluid' is used here to refer to any fluid that is used in a device in order to ensure or optimise the proper functioning of the device, where such fluid needs to be replaced, whether regularly or otherwise, for example liquid coolant, liquid lubricant and so on.

It is known that replacing such a replacement fluid in a device is often an onerous and dirty task which is very time-consuming.

For example, oil separators are known which are used to remove the oil from the compressed gas which comes from oil-injected compressors.

In such oil-injected compressors, oil is injected into the compression chamber during the compression of the gas in order to cool down the gas and lubricate the compressor element's moving parts.

Such oil separators consist, in their known form, of a reservoir shaped like a boiler in which the separated oil is collected at the bottom.

In order to change the oil during servicing, a drainage stop is provided at the bottom of such oil separators, via which the used oil can be collected in order to be disposed of.

After the oil has been drained off, the reservoir has to be refilled via a fill plug, with a gauge or dipstick being used to determine the right quantity of oil.

Obviously, a servicing intervention of this kind for changing oil is relatively laborious and time-consuming, as it is necessary to repeatedly verify whether the correct oil level has already been reached.

Moreover, it is nearly impossible to perform this work without making a mess.

There are similar disadvantages associated with replacement fluids in other types of devices.

Another disadvantage lies in the fact that the replacement fluids are usually available in standard-size packaging units which do not generally correspond to the required quantity of replacement fluid, so that it is usually necessary to purchase more product for a servicing intervention than is strictly necessary, leaving a surplus whose properties can degrade over time.

The aim of the present invention is to offer an answer to said and certain other disadvantages.

To this end, the invention relates to a reservoir for a replacement fluid for a device, where the reservoir is pre-filled with the desired quantity of the relevant replacement fluid and where this reservoir is equipped with detachable coupling devices which make it possible to mount and dismantle the reservoir on the device and where the reservoir, in its mounted state, serves as a changeable fluid reservoir for the device.

One advantage of such a reservoir according to the invention is that the replacement of the fluid can be performed rapidly, accurately and cleanly, in that only this reservoir containing the used replacement fluid needs to be replaced by a new reservoir in which a premeasured quantity of fresh replacement fluid is introduced, so that the reservoir serves as packaging for the replacement fluid for the device, both before and after the use thereof.

For example, when such a reservoir according to the invention is used with an oil separator, it is no longer necessary when replacing the oil to measure the correct quantity, of oil by means of a gauge or dipstick, as the required quantity of oil has already been introduced into the new reservoir.

Nor is it necessary to provide an extra catchment tray to catch the used oil, as the reservoir which is removed from the oil separator already contains all the used oil and can be removed in its entirety together with the oil, for recycling, for example.

The present invention also relates to a device which contains a replacement fluid, where said device is fitted with a reservoir according to the invention which contains at least a portion of the device's replacement fluid.

More specifically, the invention also relates to an oil separator in an oil-injected compressor, where said oil separator consists of firstly a housing with an inlet and an outlet for compressed gas, and secondly, a pre-filled reservoir that is secured detachably against the housing by means of detachable coupling devices and where the chambers in the housing and this reservoir are linked via orifices for the separated oil and where an offtake point is provided via which the reservoir can be connected to a circuit for the injection of the oil from the reservoir into the compressor.

With the intention of better showing the characteristics of the present invention in what follows, by way of example and without any limitative character, a number of preferred embodiments are described of a reservoir according to the invention for a replacement fluid for a device, with reference to the accompanying drawings, in which.

Figure 1:
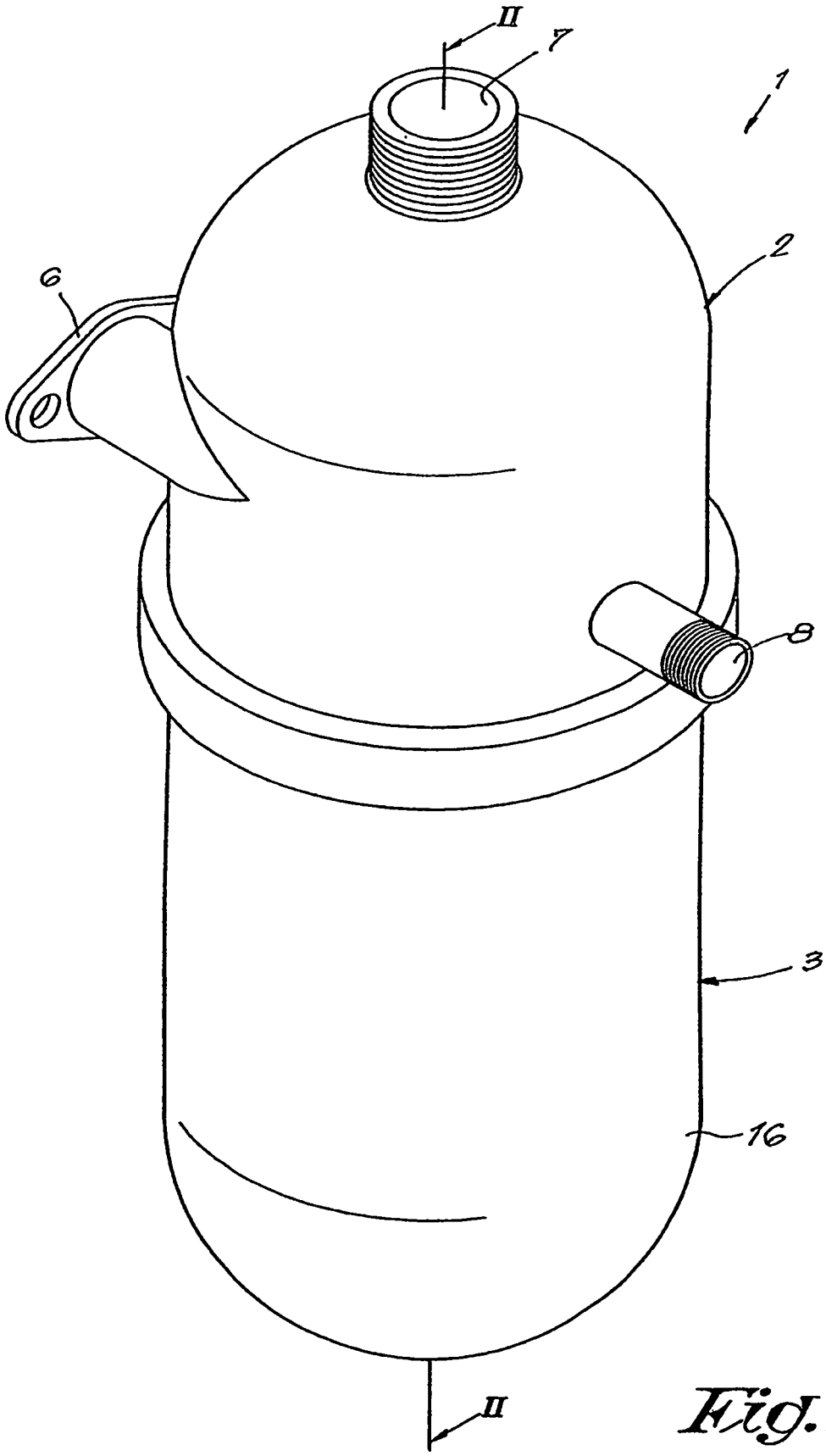
FIG. 1 is a diagrammatic and perspective representation of a device in the form of an oil separator which is fitted with a reservoir according to the invention.
Figure 2:
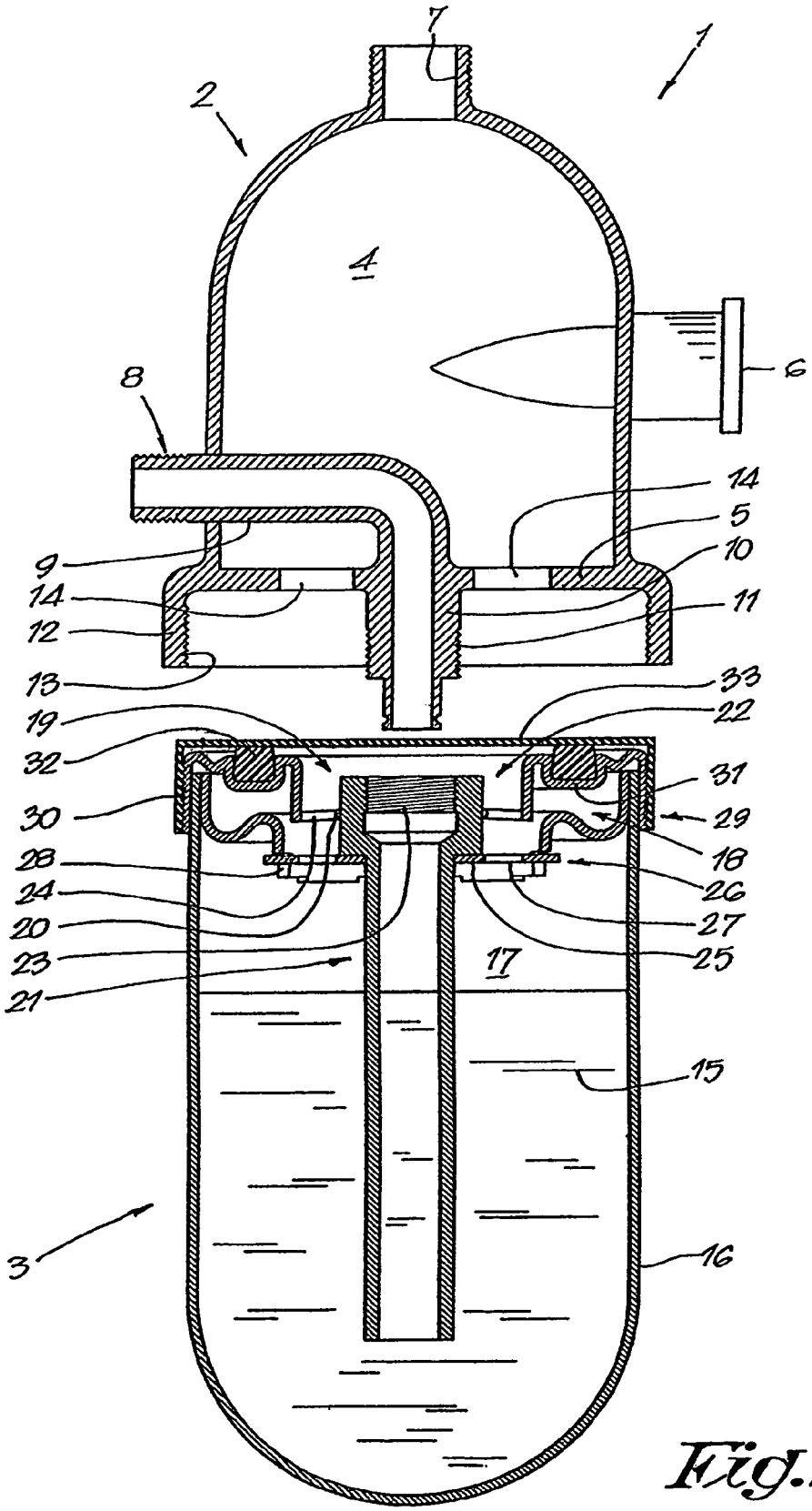
FIG. 2 represents a cross-section along line II-II in FIG. 1, but in an exploded view.

In FIG. 1, a device 1 is shown according to the invention in the form of an oil separator which is formed by a housing 2 and a reservoir 3 according to the invention, where said reservoir 3 takes the form of a changeable reservoir in which a required, measured quantity of oil is provided and which, as indicated in FIG. 2, can be secured against the housing 2 as a separate and changeable element.

The housing 2, which for example can be made by welding or casting, is in this case bell-shaped, encloses a separating chamber 4 and is also provided with a floor 5.

In the side of said housing 2 a tangentially inserted inlet opening 6 is provided, as well as an outlet opening 7 on the top of the housing 2, which inlet opening 6 is provided in order to be connected to the outlet of an oil-injected compressor, while the outlet 7 is provided in order to be connected to a mains network.

Further, the housing 2 is provided with an offtake point 8, which in this case takes the form of the extremity of a feed-through line 9, which passes through the wall of the housing 2 and whose other extremity connects to a nipple 10 which is fastened at the bottom to the floor 5 and which is provided with an external screw thread 11.

Likewise, on the underside and across the entire periphery of the floor 5 a downwards-pointing flange 12 is introduced which is provided with an internal screw thread 13 with a pitch greater than that of said external screw thread 11 on the nipple 10.

Finally, in the floor 5 further orifices 14 are provided which extend round said nipple 10.

Said reservoir 3 according to the invention takes the form of a changeable reservoir in which a pre-measured required quantity of replacement fluid 15, such as oil for example, is introduced.

This reservoir 3 mainly consists of a virtually barrel-shaped receptacle 16 which contains a chamber 17 which holds said quantity of oil and which is also bounded by an upper wall 18 with a centrally deepened section 19 with a central opening 20 through which a suction line 21 is introduced which extends axially into the reservoir 3 to a certain distance from the floor of the reservoir 3 and which is provided with a widened section 22 which protrudes through said opening 20 and is provided with an internal screw thread 23 which can mate with the external screw thread 11 of the nipple 10.

In the deepened section 19, a number of orifices 24 are introduced round the widened section 22 of the suction line 21.

Said suction line 21 is held in place in the reservoir 3 by means of a ring 25 which is introduced round the suction line 21 so that it can be moved but cannot be rotated, and which is secured at its edges on a support 26 in the form of a profiled plate whose edges are fastened to the inner wall of the reservoir 3.

The ring 25 is, in its resting state, fastened securely to the support 26 and is provided with orifices 27.

Between the ring 25 and the support 26, a snap-off or click-apart mechanism is provided so that, after sufficient axial force has been exerted on the suction line 21, the ring 25 snaps off or clicks apart from the support 26.

The support 26 is also provided with a short tubular section 28 in which said ring 25, after it has snapped off, can be moved over a short distance in the axial direction without rotating, after which the ring 25 completely detaches from the support 26.

The reservoir 3 is provided with coupling devices 29 which enable the reservoir 3 to be mounted on and dismantled from the housing 2, with these coupling devices 29 being formed in this case by the fact that the barrel-shaped reservoir 3 is provided at the top around its periphery with an external screw thread 30 which mates with the internal screw thread 13 on the flange 12 of the housing 2.

In the upper wall 18 of the reservoir 3, a groove 31 is provided which contains a seal 32.

As shown diagrammatically in FIG. 2, the reservoir is covered with a removable lid 33.

The use of the reservoir 3 according to the invention is very simple, and is represented in steps in FIGS. 2 to 5.

FIG. 2 shows the starting situation, in which an oil change needs to be performed and, after the removal of a used reservoir 3, a new changeable reservoir 3 needs to be introduced.

Figure 3:
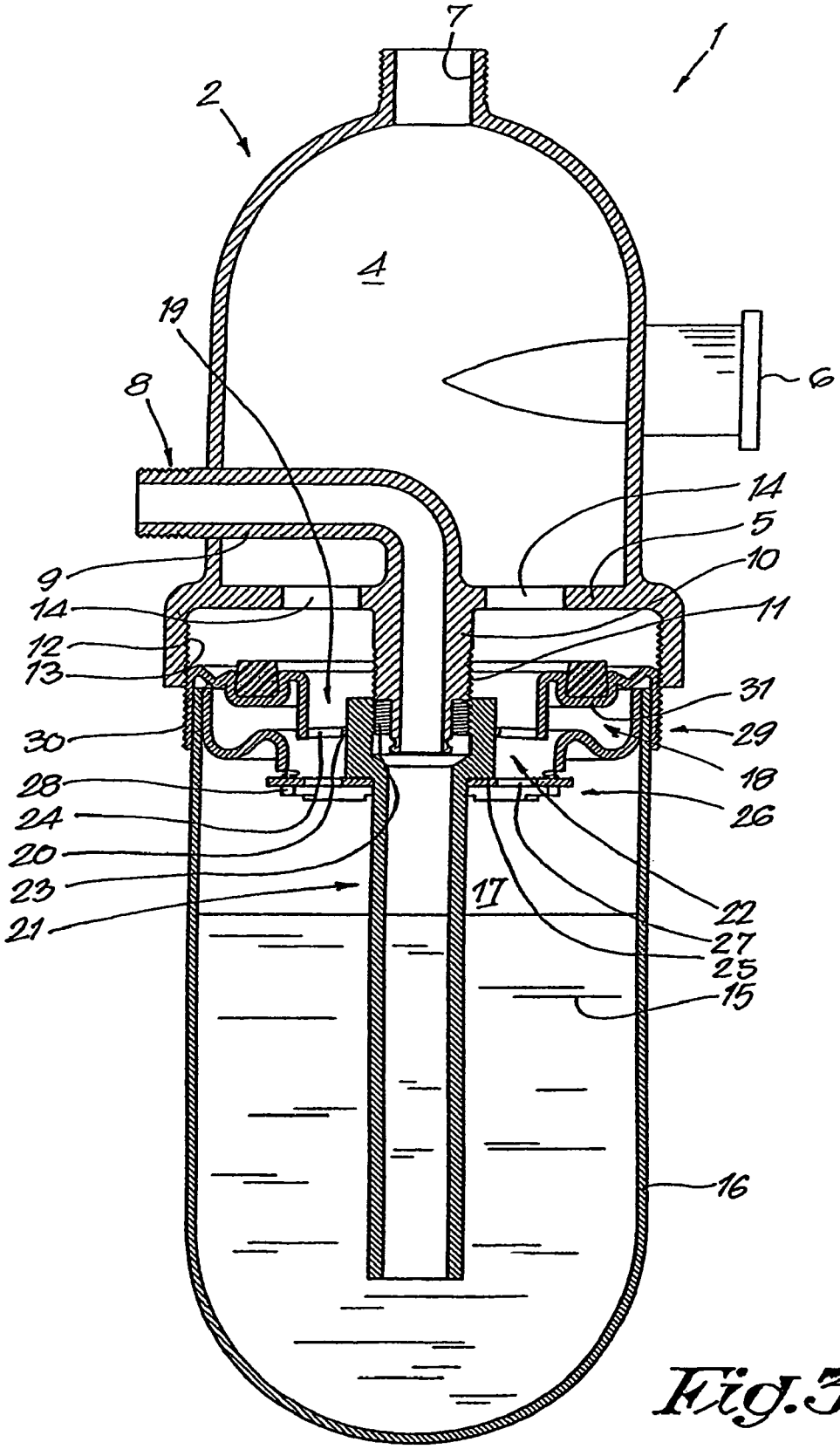
FIGS. 3 to 5 illustrate the use of a reservoir according to the invention step by step.
Figure 4:
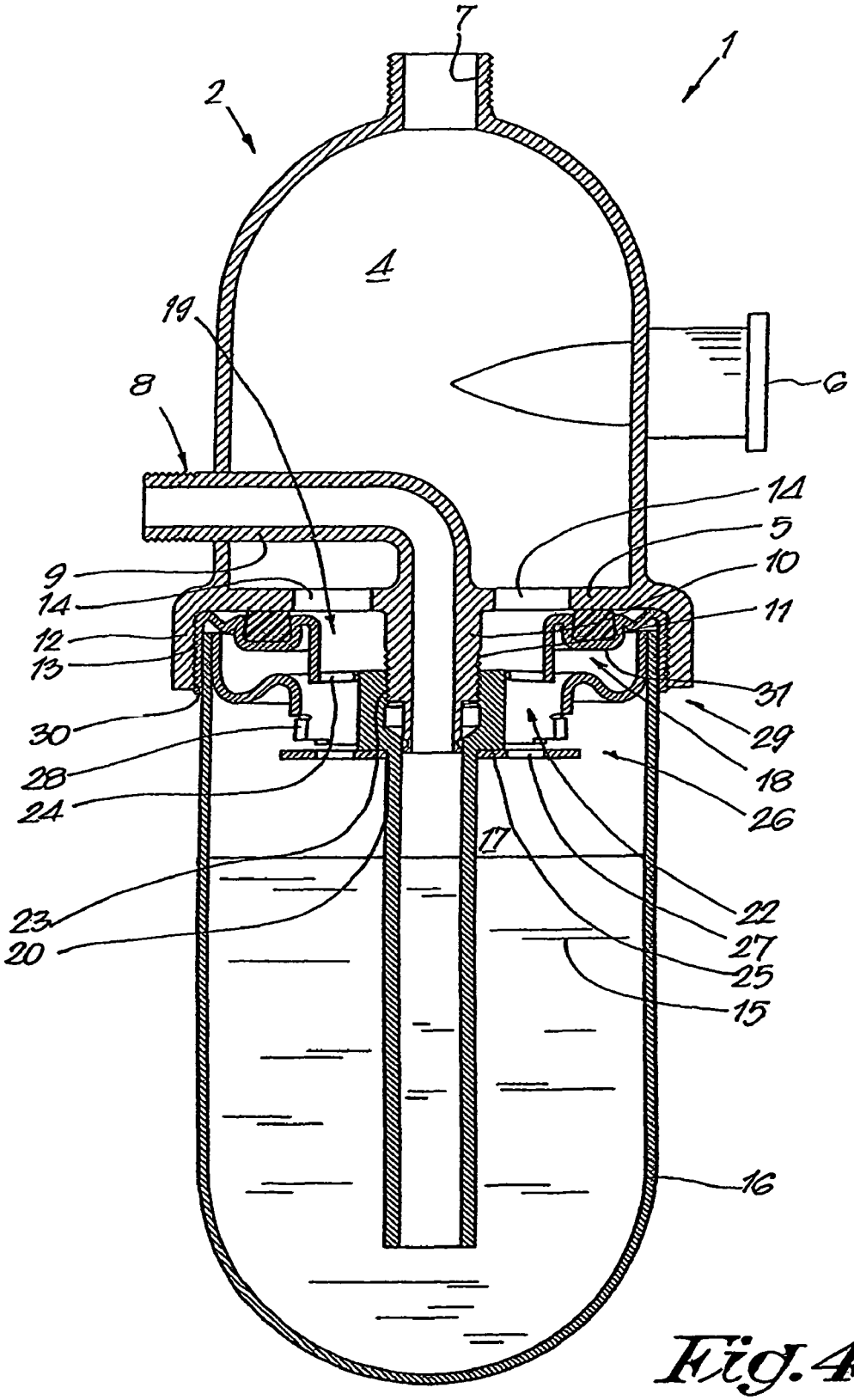

To this end, after the removal of the lid 33, the reservoir 3 is mounted on the bottom of the housing 2 by twisting the reservoir 3 with its screw thread 30 in the screw thread 13 on the bottom flange 12 of the housing 2, as a result of which the widened section 22 of the suction line 21 with its screw thread 23 is simultaneously twisted on the nipple 10, as shown in FIGS. 3 and 4.

The reservoir 3 is screwed completely tight so that the seal 32 on the top of the reservoir 3 comes into contact with the floor 5 of the housing 2, as a result of which a completely closed oil separator is obtained which consists of the housing 2 and the replacement reservoir 3.

As the pitch of the outermost screw threads 13 and 30 is greater than the pitch of the innermost screw threads 11 and 23, the suction line 21 will, when the reservoir 3 is screwed onto the housing 2, describe a lesser axial movement than the reservoir 3, and will in consequence lag behind this reservoir 3.

As a result of this, a downwards axial force is exerted on the suction line 21, due to which said snap-off or click-apart mechanism is activated, causing the ring 25 to snap off or click apart from the support 26, although the suction line 21 remains connected to the housing 2 via the screw connection between the screw threads 11 and 23, as shown in FIG. 4.

In this state, the reservoir 3 is completely mounted and the device can be put into operation, as a result of which compressed gas flows into the oil separator's tangential inlet 6 from the compressor.

As a result of this, the gas flow acquires a turbulent motion, causing, as is known, the oil particles which are included in the gas flow to be flung against walls of the housing 2, and due to gravity flows along the walls and via the orifices 14, 24 and 27 into the reservoir 3 to be collected there.

Due to the gas pressure of the oil on the oil surface in the reservoir 3, oil is forced via the suction line 21 on the reservoir 3 and the connecting feed-through line 9 on the housing 2 outwards via the offtake point 8 to feed the injection circuit with which the compressor is lubricated.

Due to the presence of the floor 5 and the upper wall 18, the oil is prevented from also starting to swirl around in the reservoir under the influence of the gas flow penetrating into the housing 2, thus preventing gas from also being conducted to the compressor via the suction line 21.

When the replacement fluid 15 eventually needs to be replaced, it is not just the oil that will be replaced, but instead the reservoir 3 will be replaced with a new replacement reservoir with fresh oil.

For this, the used reservoir 3 will need to be unscrewed again.

Due to the fact that, after the ring 25 has been snapped off or clicked free from the support 26, the ring 25 is held in the support 26 in such a way that it can be moved but cannot be rotated, the ring 25 together with the suction line 21 will turn with the reservoir 3, as a result of which the suction line 21 is unscrewed from the nipple 10.

Figure 5:
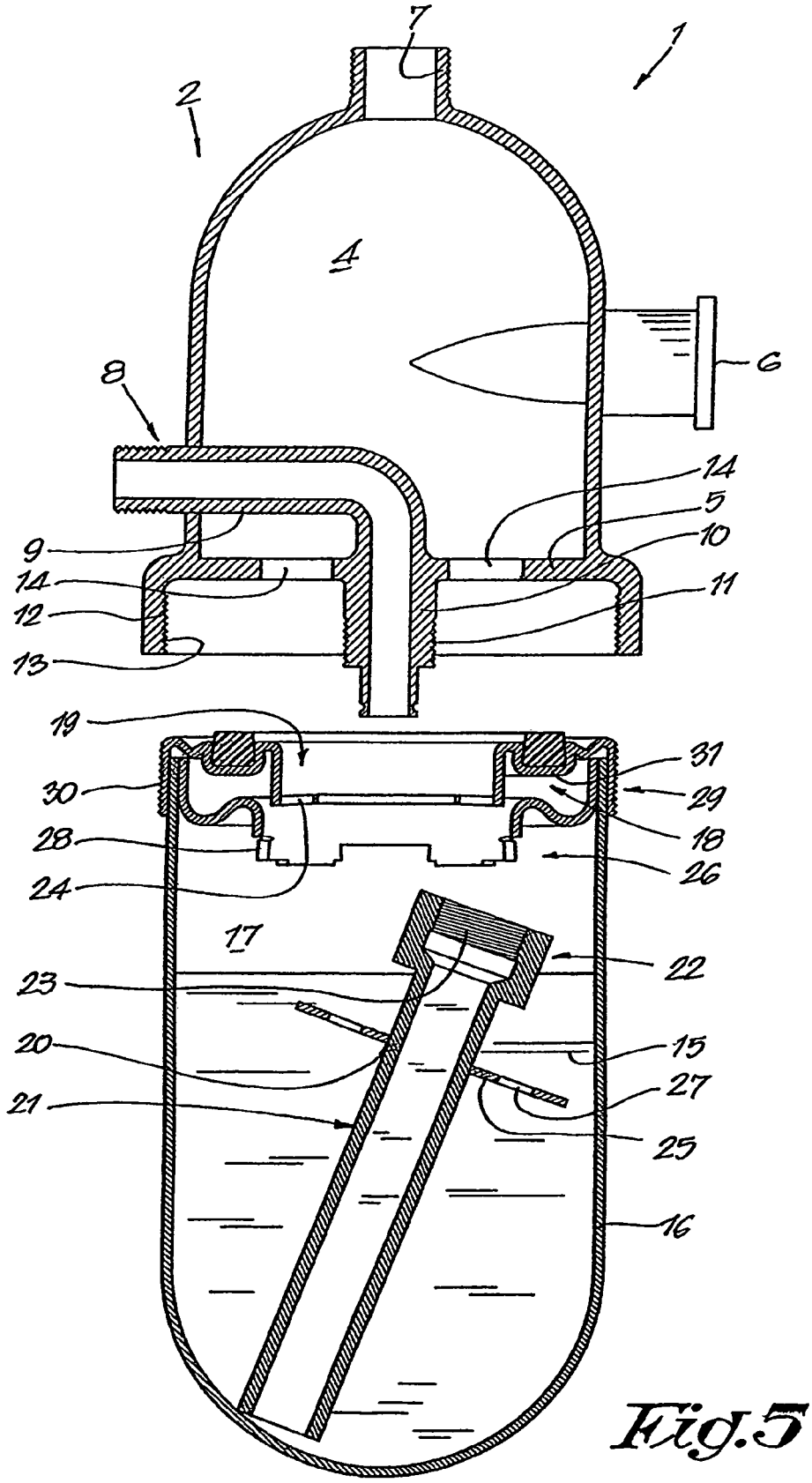

Once the suction line has been completely unscrewed from the nipple 10, it can simply slip out from the short tubular section 28 of the support 26, and hence fall into the reservoir 3, as shown in FIG. 5.

This makes it impossible for the used reservoir 3 to be reused.

The reservoir 3 can then be closed again by means of the lid 33 so that it can be taken away and where appropriate recycled in a suitable manner.

A new reservoir 3 with fresh replacement fluid 15 can then be connected to the housing 2 in the same way as described earlier, starting once again from a situation as depicted in FIG. 2.

Figure 6:
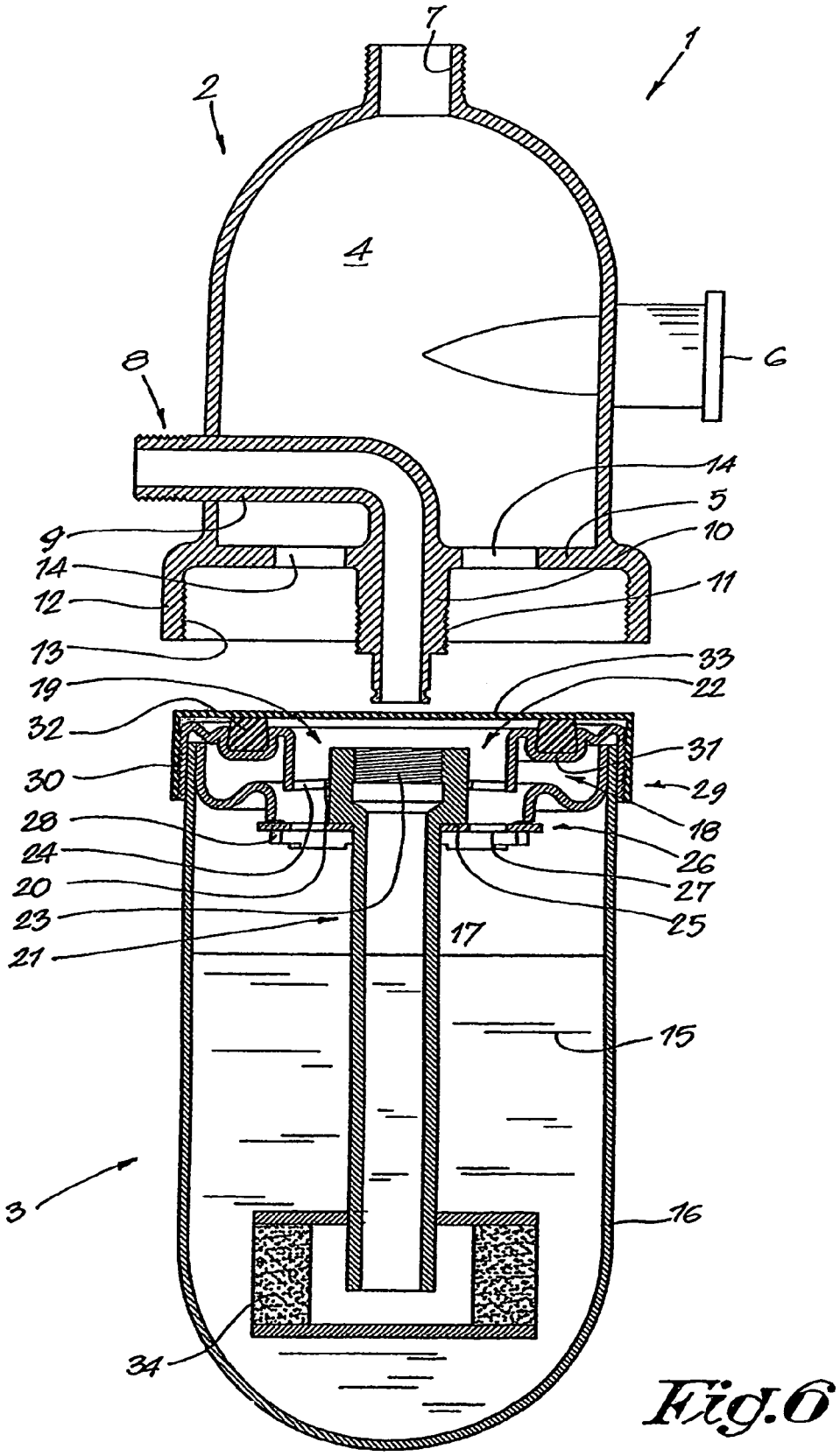
FIG. 6 represents a variant on FIG. 2.

In FIG. 6, a variant is shown of a device 1 as in FIG. 2, in which a fluid filter 34 has been introduced on the bottom free end of the suction line 21.

The advantage thereof is that, when the reservoir 3 is replaced, the filter 34 for the purification of this replacement fluid 15 will be replaced at the same time.

It is clear that said coupling devices 29 need not necessarily take the form of a screw connection, but that they can also consist of any other connecting system, which can preferably though not necessarily be manually activated, such as a bayonet fitting.

It is clear that said removable lid 33 can take many different forms which prevent leaks of replacement fluid 15 from the reservoir 3, such as a screw top, a snap-off section or a removable film.

It is likewise clear that said snap-off or click-apart mechanism can take many different forms. An example of another such mechanism is described in BE 1.011.567 by the same applicant.

The present invention is in no way limited to the embodiments described by way of example and shown in the figures, but a reservoir according to the invention for a replacement fluid for a device and a device and oil separator fitted with such a reservoir can be produced in many different forms and dimensions without departure from the scope of the invention.

The invention claimed is:

1. Oil separator for an oil-injected compressor, comprising a housing having an inlet and an outlet for compressed gas, and a reservoir that is secured detachably to the housing by means of detachable coupling arrangement and that is pre-filled with oil before being mounted to said housing, and wherein a separation chamber in the housing and a reservoir chamber are linked via orifices for separated oil and wherein an offtake point is provided via which the reservoir is connectable to a circuit for the injecting of the oil from the reservoir into a compressor, said reservoir being provided with a suction line which extends into the reservoir up to a point spaced above a floor of the reservoir and is fastened to the reservoir by means of a snap-off or click-apart mechanism.

2. Oil separator according to claim 1, wherein said coupling arrangement comprises a screw type connection.

3. Oil separator according to claim 1, wherein the coupling arrangement comprises a bayonet fitting.

4. Oil separator according to claim 1, wherein said suction line is arranged in said reservoir so as to enable drainage of the oil from the reservoir via the offtake point.

5. Oil separator according to claim 4, wherein in said separation chamber in the housing, a feed-through line for oil is provided, one of whose extremities connects to said offtake point and the other of which connects to a nipple which is fastened against a floor of said housing.

6. Oil separator according to claim 5, wherein said nipple mates with part of the suction line which extends into the reservoir.

7. Oil separator according to claim 1, wherein the snap-off or click-apart mechanism is provided between a support fastened to an inner wall of the reservoir and a ring fastened to the support so that, after sufficient axial force is exerted on the suction line, the ring snaps off or clicks apart from the support.

8. Oil separator according to claim 7, wherein the support is provided with a tubular section in which said ring can move over a short distance axially after the ring snaps off or clicks apart from the support.

9. Oil reservoir for an oil separator of an oil-injected compressor, comprising a detachable coupling means for detachably securing said reservoir against a housing of the oil separator; said reservoir being pre-filled with the desired quantity of the oil before being mounted to said housing, and being provided with a suction line which extends into the reservoir up to a certain distance above a floor of the reservoir, said suction line being fastened to the reservoir by a snap-off or click-apart mechanism; and wherein said reservoir includes an upper wall provided with a plurality of orifices defined therethrough and positioned around the suction line to allow oil to flow from said housing into said reservoir.

* * * * *